US008859917B2

(12) United States Patent
Li et al.

(10) Patent No.: US 8,859,917 B2
(45) Date of Patent: Oct. 14, 2014

(54) ELECTRICAL SWITCH LATCH ASSEMBLY

(75) Inventors: Jun Li, Shanghai (CN); Darrell S. Filtz, Cedarburg, WI (US)

(73) Assignee: Rockwell Automation Technologies, Inc., Mayfield Heights, OH (US)

( * ) Notice: Subject to any disclaimer, the term of this patent is extended or adjusted under 35 U.S.C. 154(b) by 309 days.

(21) Appl. No.: 13/282,314

(22) Filed: Oct. 26, 2011

(65) Prior Publication Data

US 2012/0103769 A1 May 3, 2012

(51) Int. Cl.
*H01H 1/64* (2006.01)
*H01H 3/20* (2006.01)

(52) U.S. Cl.
CPC ..... *H01H 3/20* (2013.01)
USPC ..... 200/293; 200/321

(58) Field of Classification Search
USPC ..... 200/296, 321, 325, 329–330, 520
See application file for complete search history.

(56) References Cited

U.S. PATENT DOCUMENTS

| | | | | |
|---|---|---|---|---|
| 5,178,504 | A * | 1/1993 | Falchi | 411/553 |
| 6,198,058 | B1 | 3/2001 | Graninger et al. | |
| 6,376,785 | B1 | 4/2002 | Graninger | |
| 6,531,669 | B1 | 3/2003 | Miller et al. | |
| 7,342,194 | B2 | 3/2008 | Karweik et al. | |
| 7,371,986 | B2 | 5/2008 | Varland et al. | |

* cited by examiner

*Primary Examiner* — Xuong Chung Trans
(74) *Attorney, Agent, or Firm* — Fletcher Yoder, P.C.

(57) ABSTRACT

A latch assembly is provided for securing a switch operator to a contact block. The latch assembly includes a collar designed to retain the switch operator in the latch assembly. The latch assembly also includes a housing having one or more apertures for receiving fasteners to secure the contact block to the latch assembly. The collar is displaceable within the housing between a locked position that secures the switch operator and an unlocked position that permits disengagement of the switch operator from the collar. When the collar is in the locked position, corresponding apertures in the collar align with the one or more apertures in the housing, permitting the fasteners to be inserted through the collar apertures. Insertion of the fasteners through the collar apertures secures the collar in the locked position, thereby impeding unintentional disconnection of the switch operator from the latch assembly.

20 Claims, 7 Drawing Sheets

ELECTRICAL SWITCH LATCH ASSEMBLY

CROSS REFERENCE TO RELATED APPLICATIONS

This application claims priority from and the benefit of Chinese Application No. 201020589674.7, filed on Oct. 29, 2010 entitled "Programmable Controller Component with Assembly Alignment Features", which is herein incorporated by reference.

BACKGROUND

The invention relates generally to the field of electrical switches, and more particularly to a latch assembly that provides a secure connection to a switch operator.

Electrical switch assemblies are widely used to control industrial equipment. Typically, an electrical switch assembly includes a switch operator, such as a push button, that is mounted to a front of a panel. The electrical switch assembly also includes an electrical switch, such as a contact block, that is mounted on the back of the panel and connected to equipment controlled by the switch. A latch assembly is also mounted on the back of the panel and used to secure the switch operator to the electrical switch.

A contact block generally includes a housing that contains normally opened and/or normally closed contacts. Actuation of the switch operator engages or disengages the contacts, thereby altering an operational state of equipment connected to the electrical switch assembly through the contact block. For example, when a normally opened contact is employed, actuation of the switch operator closes the normally opened contact to engage and/or start operation of equipment connected to the contact block. In contrast, a normally closed contact may be employed to stop an ongoing function by actuation of the switch operator. One common example of a normally closed contact is an emergency stop (E-Stop) function, where the switch operator may be activated to immediately terminate an ongoing function.

Latch assemblies are typically connected to switch operators through snap features, or other fastening devices, that provide for easy assembly and disconnection. However, if a latch assembly becomes dislodged or disconnected from a switch assembly, actuation of the switch operator may no longer have the desired effect on the controlled circuit within the contact block. Further, electrical switches are more frequently desired in industrial environments, which may be subject to shock and vibrations. Accordingly, there is a need for enhanced security of the connection between the latch assembly and the switch operator while still providing for easy connection and/or disconnection of the latch assembly from the switch operator.

BRIEF DESCRIPTION

The present invention provides a novel latch assembly designed to respond to such needs. The latch assembly includes a collar designed to retain the switch operator in the latch assembly. For example, the collar may include one or more retention features, such as tabs, designed to mate with complementary retention features, such as slots, on the switch operator. The latch assembly also includes a housing having one or more apertures for receiving fasteners to secure the contact block to the latch assembly. The collar is displaceable within the housing between a locked position that secures the switch operator to the collar and an unlocked position that permits disengagement of the switch operator from the collar.

When the collar is in the locked position, corresponding apertures in the collar align with the one or more apertures in the housing, permitting the fasteners to be inserted through the collar apertures. In particular, the fasteners can be inserted through the contact block, through the latch housing, and through the latch collar to secure the contact block to the latch assembly and to inhibit movement of the collar from the locked position. The connection of the fasteners to the collar reduces unintended movement of the collar from the locked position, for example, due to shock or vibration, thereby impeding unintentional disconnection of the switch operator from the latch assembly.

According to certain embodiments, the latch assembly includes a housing base with a sleeve that extends from the base towards a cover. The collar is a circular structure rotatably disposed around the sleeve and secured in the housing base by the cover. The collar includes a pair of tabs designed to fit within corresponding slots on the switch operator to secure the switch operator to the collar. The collar also includes a pair of protrusions designed to fit within slots on the switch operator to secure the switch operator to the collar. The protrusions include threaded apertures designed to align with apertures in the housing base. When the collar is in the locked position, the protrusion apertures align with apertures in the housing base, allowing fasteners, such as screws, to be inserted into the protrusion apertures to secure the collar in the locked position. When the fasteners are removed from the apertures, the collar may be rotated to an unlocked position, where the tabs and protrusions can be disengaged from the slots in the switch operator to disconnect the switch operator from the latch assembly.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
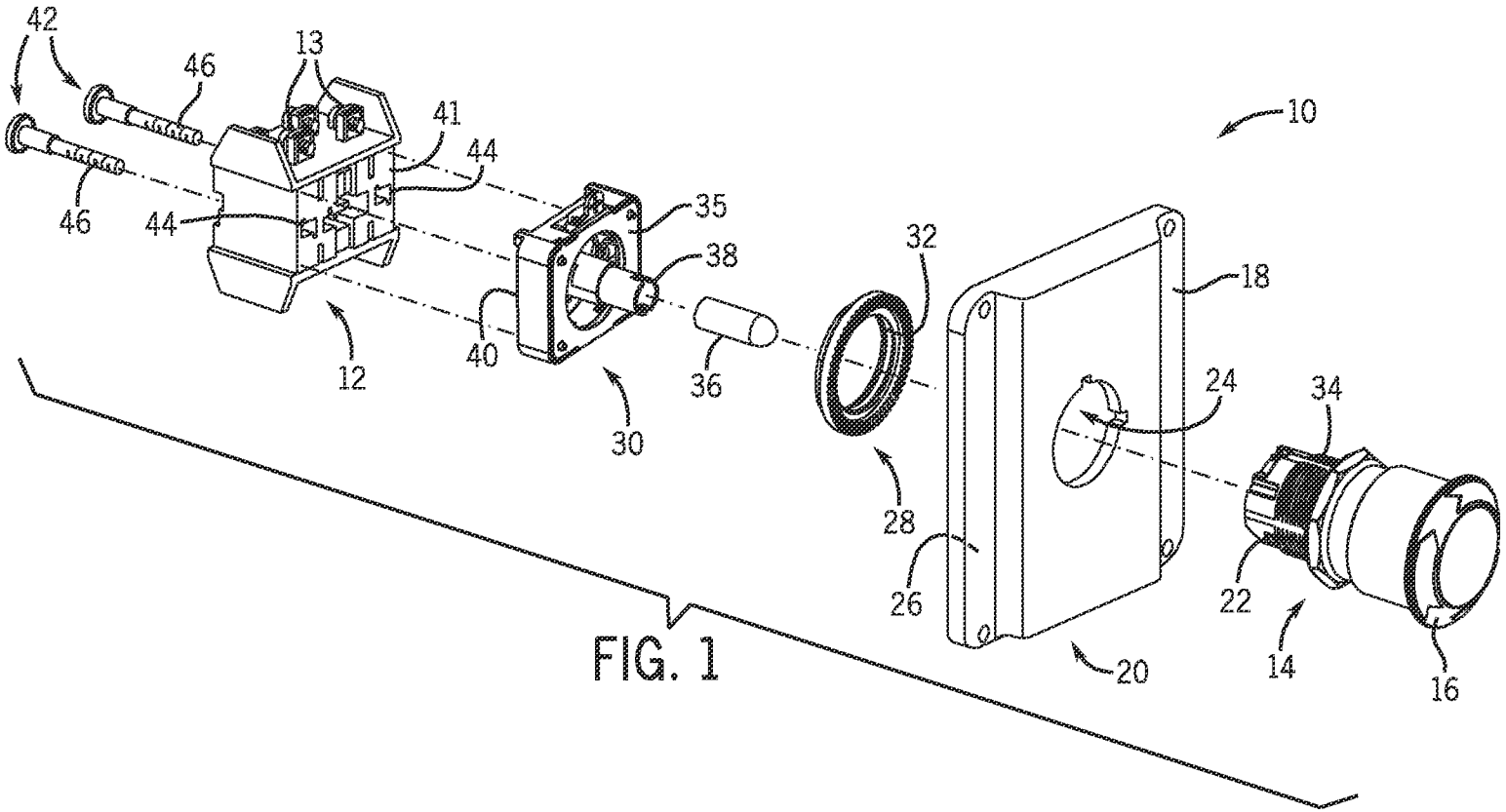
FIG. 1 is an exploded view of an exemplary switch assembly that may employ a latch assembly in accordance with the present techniques.

FIG. 1 is an exploded view of a switch assembly 10 that may be manipulated by a user to control a device, such as industrial machine, that is connected to the switch assembly. The switch assembly 10 includes a switching device, such as a contact block 12 that includes terminals 13 that enable wires and/or ring lug connectors to be coupled to one or more internal electrical contact pairs that are normally opened or normally closed. Switch assembly 10 also includes a switch operator 14 that can be actuated by a user to move the electrical contact pairs within the contact block 12 between opened and closed positions. In particular, the switch operator 14 includes a button 16 that extends from a front side 18 of a panel 20. According to certain embodiments, the panel 20 may be a sheet metal panel that houses one or more switch operators 14. The button 16 can be depressed and/or twisted by a user to actuate the switch operator 14 and engage the contact block 12, thereby changing the position of the internal electrical contact pairs.

The switch operator 14 also includes a bushing 22 that extends through an aperture 24 within the panel 20 to be secured to a rear side 26 of the panel 20. In particular, the bushing 22 can be coupled to a mounting ring 28 and a latch assembly 30. The mounting ring 28 includes threads 32 that interface with a threaded portion 34 of bushing 22 to couple the mounting ring 28 to the bushing 22, with the panel 20 disposed between the mounting ring 28 and the portion of the switch operator 14 that extends from the front side 18 of the panel 20.

The latch assembly 30 includes one or more retention features designed to mate with complementary retention features on the switch operator to couple the latch assembly 30 to the switch operator 14, as discussed further below with respect to FIGS. 3 and 4. According to certain embodiments, the latch assembly 30 may be inserted onto bushing 22 and snapped into place by hand. When assembled, a front side of the latch assembly 30, shown here as a cover 35, may be disposed against the rear side 26 of the panel 20. An optional lamp 36 may be inserted into a lamp socket 38 of the latch assembly 30 to illuminate the button 16 on switch operator 14. For example, the lamp socket 38 and the lamp 36 may be inserted into the bushing 22 and may extend through the aperture 24 in the panel 20. However, in other embodiments where illumination is not desired, the lamp 36 and/or the lamp socket 38 may be omitted. Further, in certain embodiments, gaskets, seals, and/or fasteners may be employed to secure switch operator 14 to panel 20, instead of, or in addition to, the mounting ring 28.

The latch assembly 30 also provides a mounting surface for contact block 12. In particular, a rear surface, shown here as a base 40, may provide a mounting surface for a housing 41 of the contact block 12. Fasteners 42, such as screws, may be inserted through openings 44 in the housing 41. Threaded portions 46 of the fasteners 42 may extend into the latch assembly 30 where the threaded portions 46 may mate with complementary threads in the latch assembly 30. As shown in FIG. 1, two fasteners 42 are employed to secure the contact block 12 to the latch assembly 30. However, in other embodiments, any number of one or more fasteners 42 may be employed.

Figure 2:
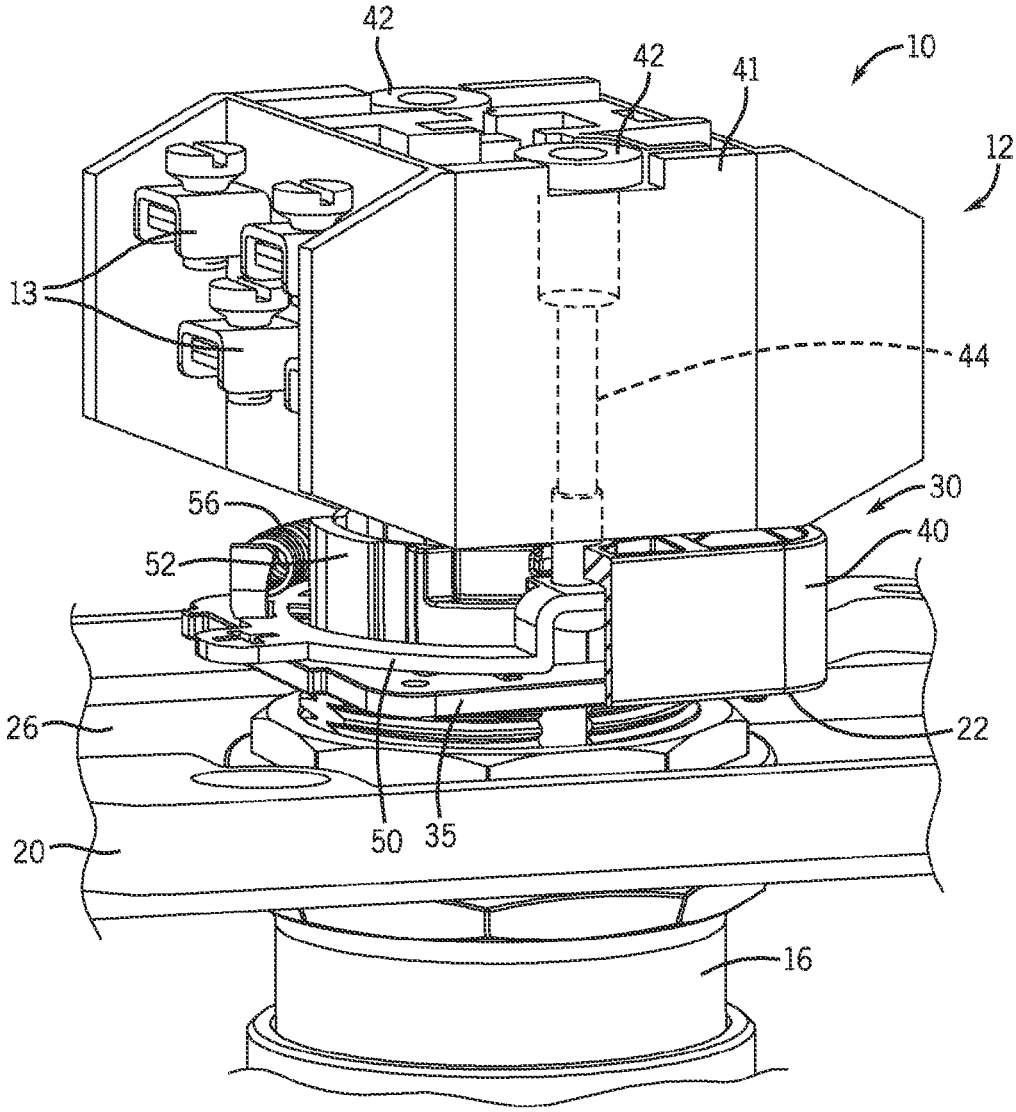
FIG. 2 is a perspective view of the switch assembly of FIG. 1.

FIG. 2 is a perspective view of the switch assembly 10, with a portion of the latch base 40 cut-away to show the interior of the latch assembly 30. As shown, when assembled, the contact block 12 is coupled to the latch assembly 30 by the fasteners 42. In particular, the fasteners 42 extend through the apertures 44 in the contact block 12 and into the latch assembly 30. The latch assembly 30 includes the base 40 and the cover 35, as well as a collar 50 disposed between the base 40 and the cover 35. In particular, the collar 50 is disposed around a sleeve 52 of the base 40, which extends within the base 40 towards the cover 35. According to certain embodiments, the sleeve 53 may be a molded part of the base 40. The collar 50 can rotate around the sleeve 52 between a locked position (shown in FIG. 4) that secures the switch operator 14 to the latch assembly 30 and an unlocked position (shown in FIG. 5) that allows the switch operator 14 to be disconnected from the latch assembly 30. The fasteners 42 extend through the base 40 to fasten to the collar 50 of latch assembly 30. When the fasteners 42 are in place, the collar 50 is secured in the locked position by the fasteners 42. A spring 56 is disposed within the base 40 to bias the collar 50 towards the locked position.

Figure 3:
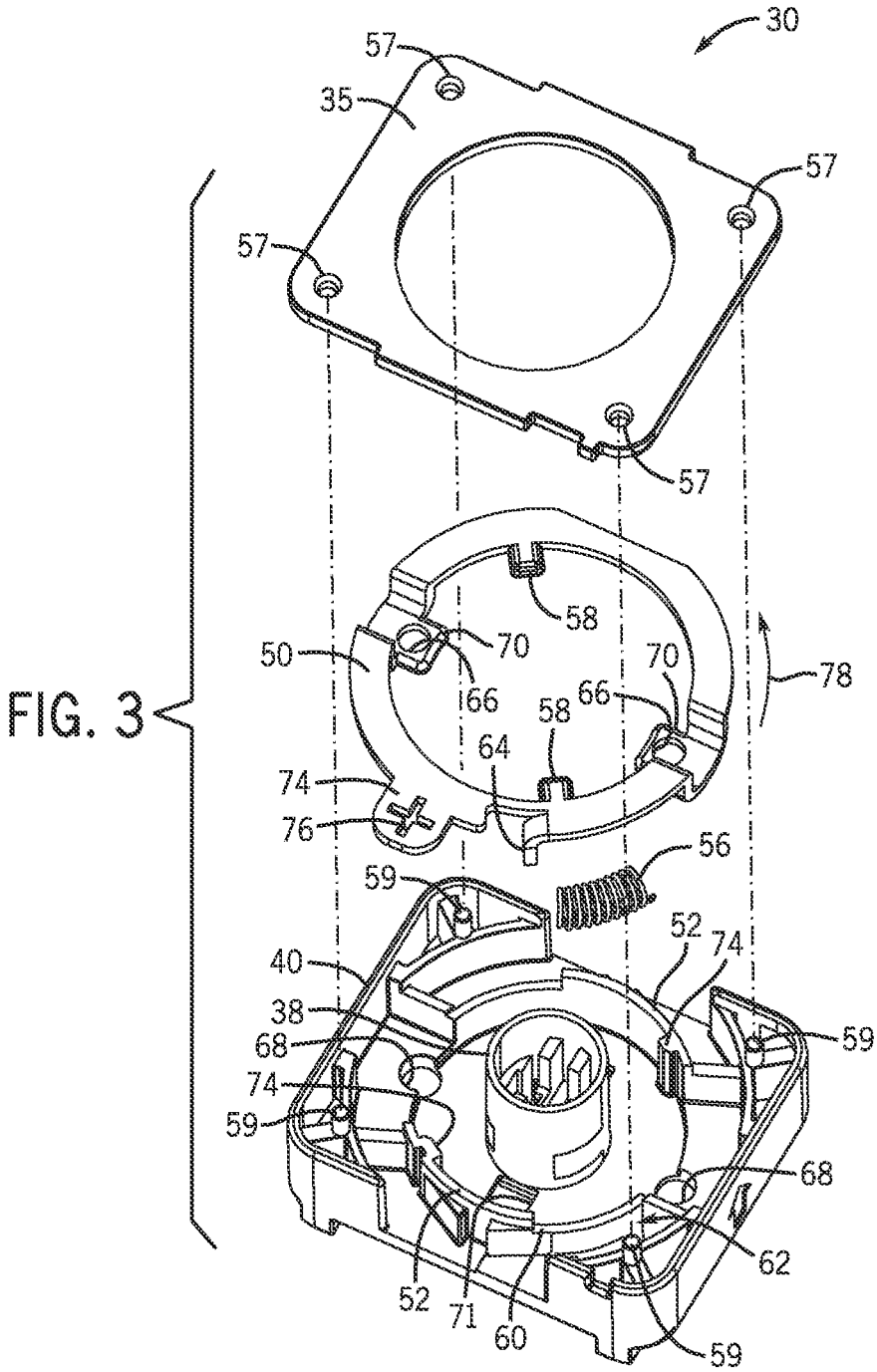
FIG. 3 is an exploded view of the latch assembly of FIG. 1.

FIG. 3 is an exploded view of the latch assembly 30. The cover 35 encloses the collar 50 within the base 40. The cover 35 includes apertures 57 that may receive bosses 59 that extend from the base 40. Upon assembly, the bosses 59 may be heat staked to secure the cover 35 to the base 40. According to certain embodiments, the collar 50 may be constructed of metal; however, in other embodiments, any suitable material may be employed. The collar 50 generally encircles the sleeve 52 of the base 40, which includes ridges 60 that support the collar 50. In particular, the collar 50 includes retention features, such as tabs 58 that rest on the ridges 60 of the base 40. When the collar 50 is in the locked position, the tabs 58 may interface with complementary retention features on the switch operator 14 to secure the switch operator 14 to the collar 50. As the collar 50 rotates around the sleeve 52, the tabs 58 may slide along the ridges 60. Although only one ridge 60 is shown in FIG. 3, a corresponding ridge is disposed on the opposite side of the base 40 (hidden from view by the collar 50). When installed in the base 40, the collar 50 covers a slot 62 in the base 40 that houses the spring 56. A spring retaining feature 64 of the collar 50 encloses the spring 56 within the slot 62. The spring 56 is designed to press against the spring retaining feature 64 and bias the collar 50 towards the locked position, shown in FIG. 4.

The collar 50 includes apertures 66 that align with apertures 68 in the base 40, when the collar 50 is in the locked position. The collar apertures 66 are disposed within retention features, such as protrusions 70 of the collar 50. When the collar 50 is in the locked position, the protrusions 70 may interface with complementary retention features on the switch operator 14 to secure the switch operator 14 to the collar 50. According to certain embodiments, the collar apertures 66 are threaded apertures designed to mate with the threaded portions 46 of the fasteners 42 (FIG. 1). When the fasteners 42 are inserted through the collar apertures 66, the fasteners 42 inhibit rotation of the collar 50, thereby securing the collar 50 in the locked position. The fasteners 42 also extend through the base apertures 68 to secure the contact block 12 (FIG. 1) to the latch assembly 30. According to certain embodiments, the base apertures 68 may be relatively smooth openings; however, in other embodiments, the base apertures 68 may be threaded to mate with the threaded portions 46 of fasteners 42. The base 40 also includes apertures 71 designed to allow a portion of the switch operator 14 to extend through the base 40 to engage and/or disengage electrical contact pairs in the contact block 12, when the contact block 12 is mounted to the base 40. The base 40 further includes alignment features 74 designed to mate with complementary alignment features of the switch operator 14 to facilitate proper alignment of the switch operator 14 in the base 40.

The collar 50 includes a release feature, such as a tab 74 that may be manipulated by a user to rotate the collar 50 to the unlocked position. According to certain embodiments, the tab 74 includes an aperture 76 for receiving a tool, such as a screwdriver, that can facilitate rotation of the collar 50. However, in other embodiments, the aperture 76 may be omitted. Further, in other embodiments, the geometry, size, and/or shape of the tab 74 and/or the aperture 76 may vary. A user may move the tab 74 in the direction of an arrow 78 to rotate the collar to the unlocked position. In the unlocked potion, the spring retaining feature 64 may press against the spring 56 to compress the spring and rotate the collar 50 relative to the base 40 and the cover 35. When the user releases the tab 74, the spring 56 may bias the collar 50 back to the locked position.

Figure 4:
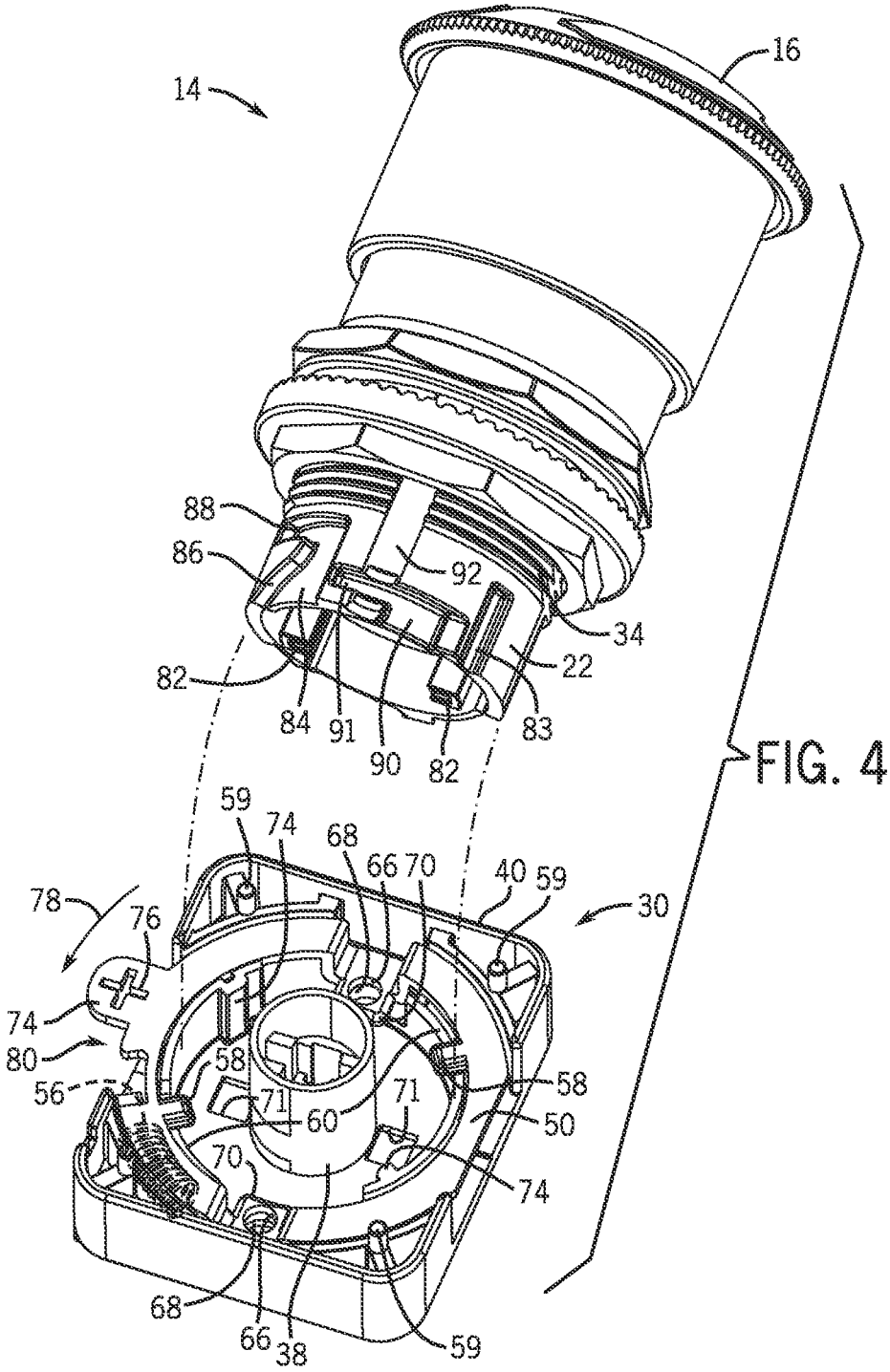
FIG. 4 is a partially exploded view depicting connection of a switch operator to a latch assembly.

FIG. 4 is an exploded view showing the switch operator 14 exploded from the latch assembly 30 to illustrate attachment of the switch operator 14 to the collar 50. For ease of illustration, the cover 35 has been omitted. As shown in FIG. 4, the collar 50 is located in the locked position 80 where the collar apertures 66 align with the base apertures 68. When the collar 50 is in the locked position 80, the switch operator 14 can be inserted into the latch assembly 30 so that prongs 82 of the switch operator 14 extend through apertures 71 in the latch base 40. When the contact block 12 is mounted on the latch assembly 30, the prongs 82 may extend into the contact block 12 upon actuation of the button 16 to engage or disengage the contact pairs included within the contact block 12. Further, when the switch operator 14 is inserted in the base 40, the bushing 22 may be disposed within the sleeve 60. To facilitate alignment of the switch operator 14 in the base 40, the switch operator 14 includes alignment features, such as grooves 83 that receive the alignment features 74 of the base 40. Although only one groove 83 is depicted in FIG. 4, one or more additional grooves may be included on the bushing 22.

The switch operator 14 also includes retention features, such as one or more grooves 84 that facilitate insertion of the switch operator 14 into the latch assembly 30. The groove 84 includes a cam surface 86 that contacts one of the tabs 58 on the collar 50. In certain embodiments, another groove 84 may be disposed on the opposite side of the bushing 22 to receive the other tab 58. As the tab 58 contacts the cam surface 86, the cam surface urges the tab 58 and the collar 50 in the direction of the arrow 78 toward the unlocked position (shown in FIG. 5) until the tab 58 slides upwardly along the cam surface 86 to fit within a slot 88. When the tab 58 reaches the slot 88, the spring 56 may bias the collar 50 back to the locked position 80, shown in FIG. 4.

The switch operator 14 also includes retention features, such as one or more grooves 90 that receive the protrusions 70. Upon insertion of the switch operator 14 within the latch assembly 30, a protrusion 70 slides through the groove 90 until the protrusion 70 is retained within a slot 91. In certain embodiments, another groove 90 may be disposed on the opposite side of the bushing 22 to receive the other protrusion 70. When the protrusion 70 is retained within the slot 91, the aperture 66 of the protrusion 70 generally aligns with a longitudinal groove 92 disposed on the bushing. According to certain embodiments, the longitudinal groove 92 may provide space for one of the fasteners 42 (FIG. 2) to be inserted through the aperture 66 and extend toward the button 16.

Figure 5:
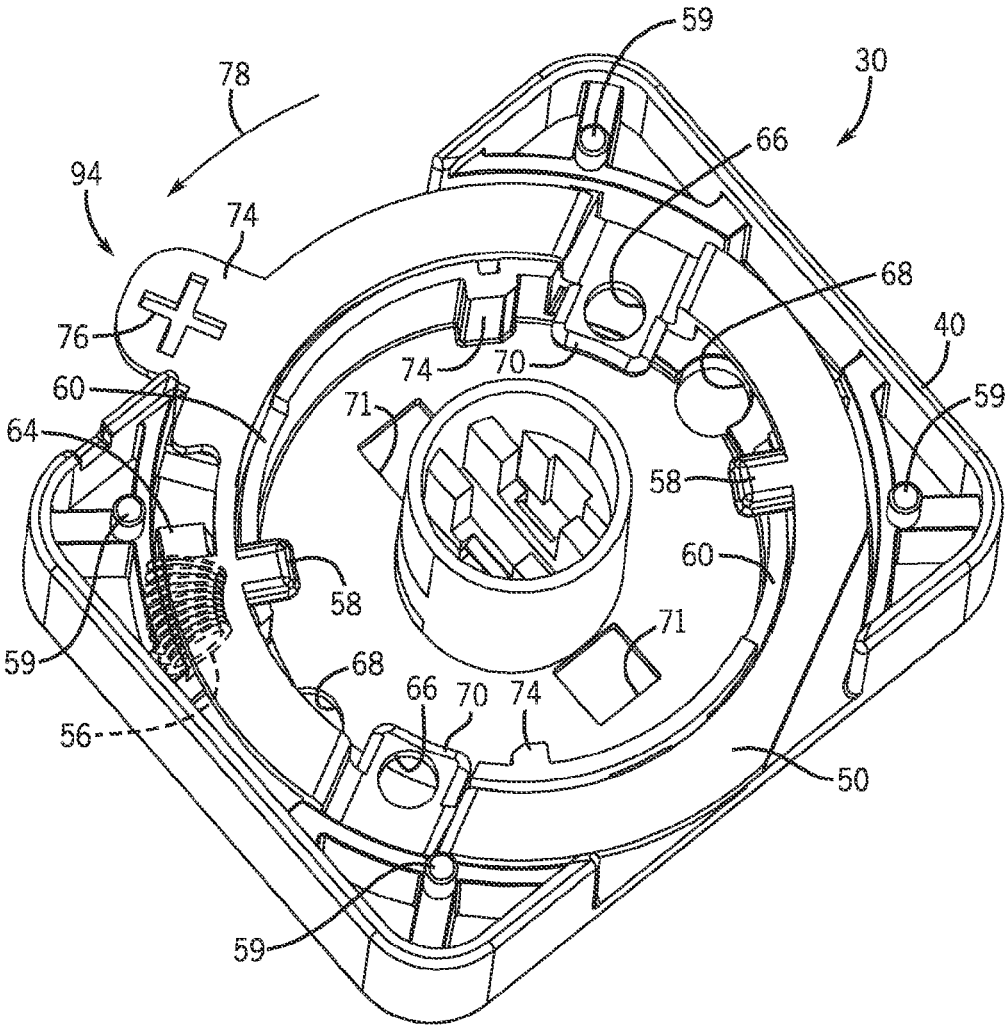
FIG. 5 is a perspective view of the latch assembly of FIG. 4 in the unlocked position.

When the collar 50 is in the locked position 80, the tabs 58 are retained within the slots 88 of the switch operator 14 and the protrusions 70 are retained within the slots 91 of the switch operator 14 to secure the switch operator 14 to the collar 50. As shown in FIG. 5, the collar 50 may be rotated to the unlocked position 94, which disengages the tabs 58 and protrusions 70 from the slots 88 and 91, allowing the switch operator 14 to be removed from the latch assembly 30. However, when the fasteners 42 are inserted through the collar apertures 66, the collar 50 is inhibited from rotational movement to the unlocked position 94, thereby further securing the switch operator 14 to the latch assembly 30. As may be appreciated, in other embodiments, the number of retention features included within the collar 50 and/or the switch operator 14 may vary. Further, in other embodiments, the shape, size, and/or geometry of the retention features may vary.

FIG. 5 depicts the collar 50 in the unlocked position 94, which allows the switch operator 14 to be disconnected from the latch assembly 30. To place collar 50 in the unlocked position 94, a user can first remove the fasteners 42. For example, a user may employ a tool, such as a screwdriver, to unscrew the fasteners 42. A user can then move the tab 74 in the direction of the arrow 78 to rotate the collar to the unlocked position 94 and compress the spring 56. As can be seen by comparing FIGS. 4 and 5, the collar 50 has rotated with respect to the base 40 to offset apertures 66 and 68 from one another. Accordingly, in the unlocked position 94, the collar apertures 66 are unaligned with the base apertures 68. As the collar apertures 66 move, the protrusions 70 also move out of the slots 91 (FIG. 4) in the switch operator 14 towards the grooves 90 (FIG. 4), which allow the protrusions 70 to slide out of the switch operator 14. In the unlocked position 94, the tabs 58 have also rotated along the ridges 60. As the tabs 58 rotate, the tabs 58 move out of the slots 88 (FIG. 4) in the switch operator 14 towards the grooves 84 (FIG. 4), which allow the tabs 58 to slide out of the switch operator 14. Once the switch operator 14 has been disconnected from the latch assembly 30, the spring 56 may bias the collar 50 back to the locked position 80, as shown in FIG. 4.

As shown in FIGS. 3 to 5, the collar 50 generally includes a circular structure that is disposed around a sleeve of the base of the latch assembly. However, in other embodiments, the collar may have a different geometry and/or may not form a complete circle. For example, FIGS. 6 to 8 depict another embodiment of a latch assembly 96 that may be employed to secure the switch operator 14 to the latch assembly 96 and to mount the contact block 12.

Figure 6:
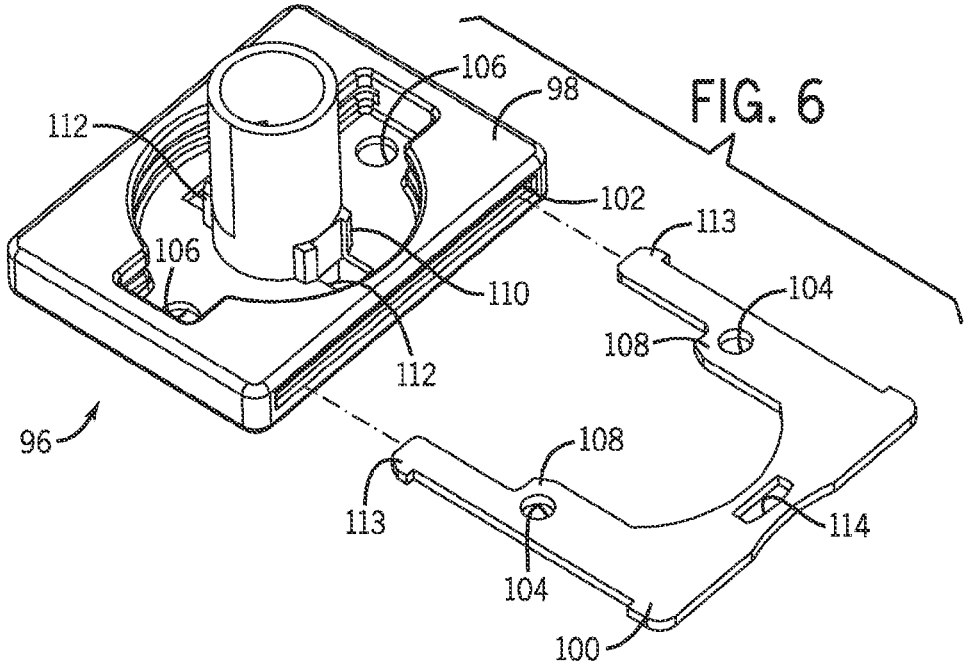
FIG. 6 is an exploded view of another embodiment of a latch assembly in accordance with the present techniques.
Figure 7:
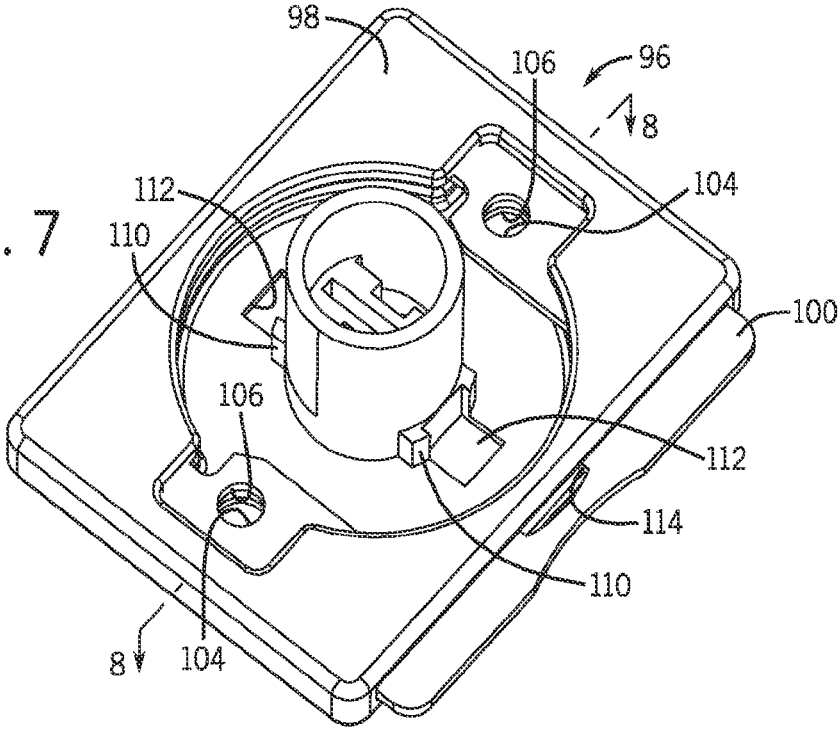
FIG. 7 is a perspective view of the latch assembly of FIG. 6.

As shown in FIG. 6, the latch assembly 96 includes a base 98 and a collar 100 that is generally a U-shaped structure. The collar 100 can be inserted within a slot 102 of the base 98, as shown in FIG. 7. When the collar 100 is fully inserted in the base 98, apertures 104 of the collar 100 are aligned with apertures 106 of the base 98, and the collar 100 is located in the locked position. Accordingly, the fasteners 42 (FIG. 1) can be inserted through the apertures 104 and 106 to secure the collar 100 in the locked position. The collar 100 can be laterally translated in the base 98 between the locked position and the unlocked position.

The collar 100 includes retaining features, such as shoulders 108 that may interface with complementary retaining features, such as slots, grooves, or other suitable types of retaining features, on the switch operator 14 to secure the switch operator 14 to the collar 100. To facilitate insertion of the switch operator 14 into the base 98, the base 98 includes alignment features 110 that may interface with complementary alignment features on the switch operator. Further, when the switch operator 14 is inserted into the base 98, prongs, such as the prongs 82 shown in FIG. 4, may extend through apertures 112 in the base 98 to engage the contact block 12 when the contact block 12 is mounted to the base 98.

Figure 8:
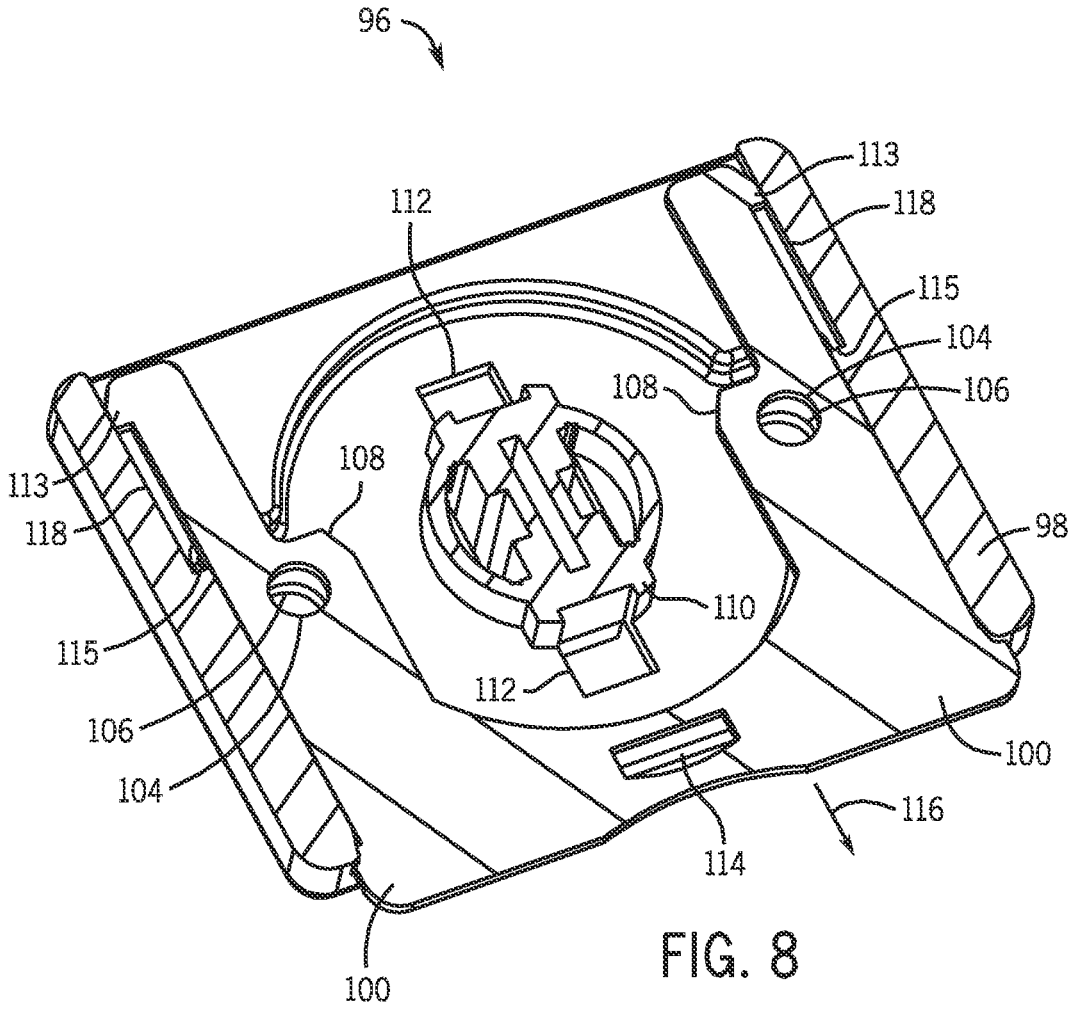
FIG. 8 is a cross-sectional view of the latch assembly of FIG. 6.

FIG. 8 is a cross-sectional view of the latch assembly 96 depicting the collar 100 in the locked position within the base 98. As shown in FIG. 8, the collar 100 includes protrusions 113 that extend past shoulders 115 within the base 98 to secure the collar 100 within the base 98. The protrusions 113 can slide along slot walls 118 of the base 98 until the collar apertures 104 align with the base apertures 106. The fasteners 42 (FIG. 1) can then be inserted through the apertures 104 and 106 to secure the collar 100 in the locked position. To remove the collar 100 from the locked position, a user may first remove the fasteners 42. A user may then employ a release feature, such as aperture 114 to remove the collar 100 from the locked position. For example, a user may insert a tool through the aperture 114 and move the collar 100 in the direction of an arrow 116 to slide the protrusions 113 along the slot walls 118 toward the shoulders 115. When the protrusions 113 are moved towards the shoulders 115, the retaining shoulders 108 of the collar 100 may no longer interface with complementary retaining features of the switch operator, thereby allowing the switch operator to be disconnected from the latch assembly 96. According to certain embodiments, the collar 100 can only be partially removed from the base 98 due to the shoulders 115 that inhibit further movement of the collar 100 out of the base 98. However, in other embodiments, the collar 100 may be fully removable from the base 98.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A latch assembly for connecting a contact block to a switch operator, the latch assembly comprising:

a latch housing comprising a housing aperture for receiving a contact block fastener; and a collar comprising a collar aperture for receiving the contact block fastener and a retention feature for securing the collar to the switch operator, wherein the collar is displaceable in the latch housing between a locked position where the collar aperture is aligned with the housing aperture and an unlocked position where the collar aperture is unaligned with the housing aperture, and wherein the contact block fastener secures the collar in the locked position when the collar aperture receives the contact block fastener.

2. The latch assembly of claim 1, wherein the collar aperture comprises threads configured to interface with a threaded portion of the contact block fastener.

3. The latch assembly of claim 1, wherein the collar is rotatable in the latch housing between the locked position and the unlocked position.

4. The latch assembly of claim 1, wherein the collar is laterally translatable in the latch housing between the locked position and the unlocked position.

5. The latch assembly of claim 1, wherein, in the locked position, the retention feature is positioned to engage a complementary retention feature on the switch operator, and wherein, in the unlocked position, the retention feature is positioned to disengage the complementary retention feature on the switch operator.

6. The latch assembly of claim 1, wherein the collar comprises a release feature actuatable by a user to place the collar in the unlocked position.

7. The latch assembly of claim 6, wherein the release feature comprises a tab and/or a slot.

8. The latch assembly of claim 1, comprising a spring disposed in the latch housing to bias the collar toward the locked position.

9. The latch assembly of claim 1, wherein the latch housing comprises a sleeve and wherein the collar is disposed rotatably around the sleeve.

10. The latch assembly of claim 1, wherein the latch housing comprises an alignment feature configured to mate with a corresponding alignment feature on the switch operator, and wherein the collar is displaceable in the latch housing with respect to the alignment feature.

11. An electrical switch assembly, comprising:

a switch operator comprising a button, and a bushing having an operator retention feature and an operator alignment feature;

a latch housing comprising a housing aperture for receiving a fastener to mount a contact block to the latch housing, and a latch alignment feature complementary to the operator alignment feature to align the switch operator within the latch housing; and a latch collar displaceable in the latch housing between a locked position and an unlocked position, and comprising a collar aperture for receiving the fastener in the locked position to secure the latch collar in the locked position, and a collar retention feature complementary to the operator retention feature, wherein the collar retention feature engages the operator retention feature in the locked position and disengages the operator retention feature in the unlocked position.

12. The electrical switch assembly of claim 11, wherein the housing aperture is aligned with the collar aperture when the collar is in the locked position.

13. The electrical switch assembly of claim 11, wherein the collar at least partially encircles the bushing.

14. The electrical switch assembly of claim 11, wherein the latch housing comprises an opening, and wherein the switch operator comprises a prong configured to extend through the opening to engage the contact block upon actuation of the button.

15. The electrical switch assembly of claim 11, wherein the operator retention feature comprises a cam surface configured to rotate the collar toward the unlocked position upon insertion of the operator switch into the latch housing.

16. The electrical switch assembly of claim 11, comprising a spring disposed in the latch housing to bias the collar towards the locked position.

17. A method, comprising:

displacing a collar to a locked position in a latch housing to secure a switch operator to the collar; and inserting a fastener through a first aperture in a contact block, a second aperture in the latch housing, and a third aperture in the collar to mount the contact block on the latch housing and to hold the collar in the locked position.

18. The method of claim 17, wherein displacing a collar comprises inserting the switch operator into the latch housing.

19. The method of claim 17, wherein displacing a collar comprises pushing the collar into a slot of the latch housing.

20. The method of claim 17, wherein displacing a collar comprises aligning a cam surface on the switch operator with a retention feature on the collar.

* * * * *